US005104262A

United States Patent [19]

Forsberg et al.

[11] Patent Number: 5,104,262

[45] Date of Patent: Apr. 14, 1992

[54] TUNNEL BORING MACHINE

[75] Inventors: Jan H. Forsberg, Enebyberg; Carl S. M. Hartwig, Täby; Nils M. Astrand, Vällingby, all of Sweden

[73] Assignee: Atlas Copco Construction and Mining Technique AB, Stockholm, Sweden

[21] Appl. No.: 543,977

[22] Filed: Jun. 26, 1990

[30] Foreign Application Priority Data

Jun. 30, 1989 [SE] Sweden ..... 8902369

[51] Int. Cl.[5] ..... E21D 9/00

[52] U.S. Cl. ..... 405/142; 405/146; 405/138; 299/53

[58] Field of Search ..... 405/138, 140, 142, 146, 405/147; 299/53, 45

[56] References Cited

U.S. PATENT DOCUMENTS

| | | | |
|---|---|---|---|
| 3,603,100 | 9/1971 | Cowley | 405/138 |
| 3,640,077 | 2/1972 | Watson et al. | 405/140 |
| 3,695,717 | 10/1972 | Birrer | 405/138 X |
| 3,840,272 | 10/1974 | Crane et al. | 405/138 X |
| 4,189,188 | 2/1980 | Schupphaus et al. | 299/53 |
| 4,530,621 | 7/1985 | Furuta et al. | 405/138 X |
| 4,793,736 | 12/1988 | Thompson et al. | 405/138 X |
| 4,834,580 | 5/1989 | Barendsen et al. | 405/138 |
| 4,915,453 | 4/1990 | Fikse | 405/138 X |

*Primary Examiner*—Dennis L. Taylor
*Assistant Examiner*—J. Russell McBee
*Attorney, Agent, or Firm*—Eric Y. Munson; Mark P. Stone

[57] ABSTRACT

Tunnel boring machine comprising a number of swingable arms (11,12,13,14) provided with boring tools (41,42,43,44) for the working of the tunnel wall outside its normal diameter. The arms may be swung outwardly into an active position or retracted into an inactive position. These tools may be independently actuated and facilitate the insertion of steel supporting arcs into the excavated area.

4 Claims, 2 Drawing Sheets

TUNNEL BORING MACHINE

BACKGROUND OF THE INVENTION

The present invention relates to a tunnel boring machine, i.e. a machine which bores the tunnel without the use of explosives.

During boring with a tunnel boring machine the boring head is pressed against the tunnel front with large force at the same time as it is rotated. During the boring one may encounter zones with weakened rock which is supported with steel arcs or reinforced in another way before the boring is continued.

SUMMARY OF THE INVENTION

The present invention, which is defined in the subsequent claims, aims at achieving a tunnel boring machine which easily can be adjusted for boring of a tunnel with somewhat larger diameter to give place for insertion of steel arcs.

DESCRIPTION OF THE BEST MODE FOR CARRYING OUT THE INVENTION

Figure 1:
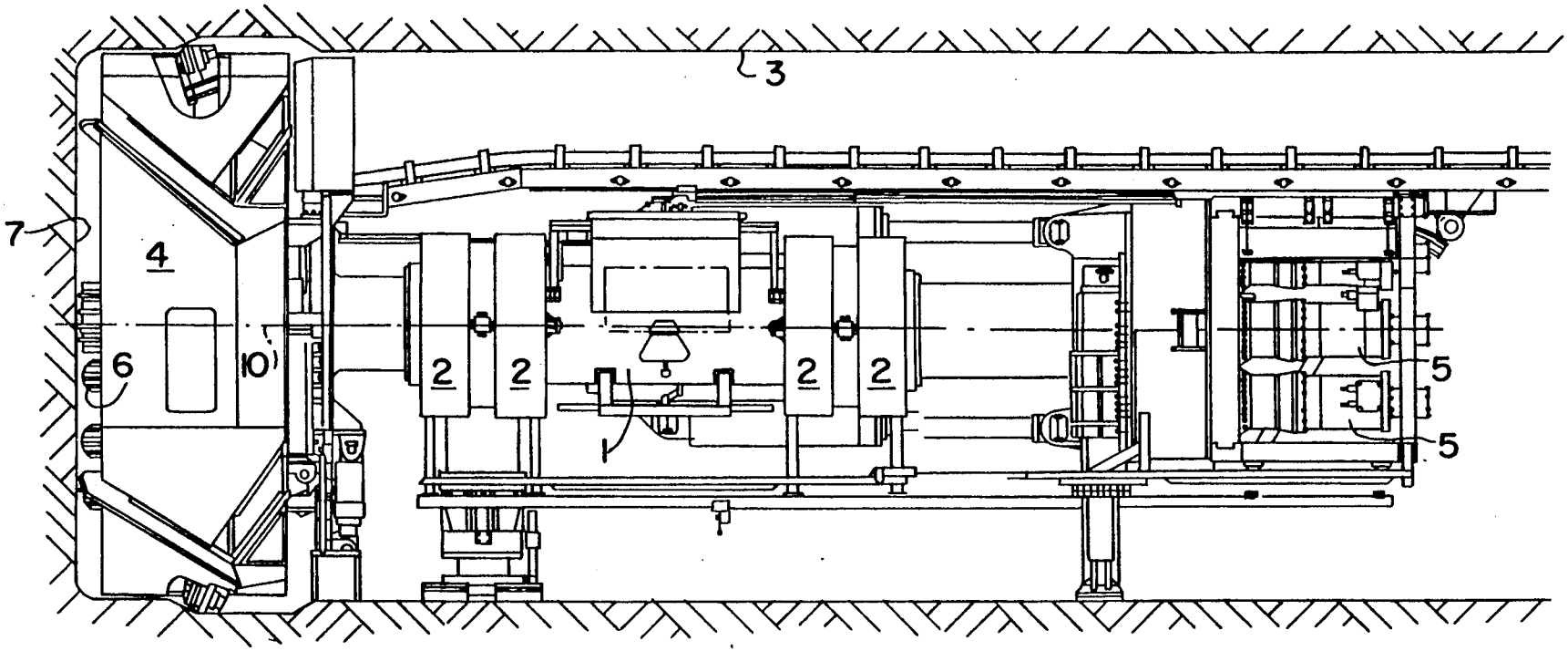
FIG. 1 illustrates a side view of a tunnel boring machine in accordance with the present invention.
Figure 3:
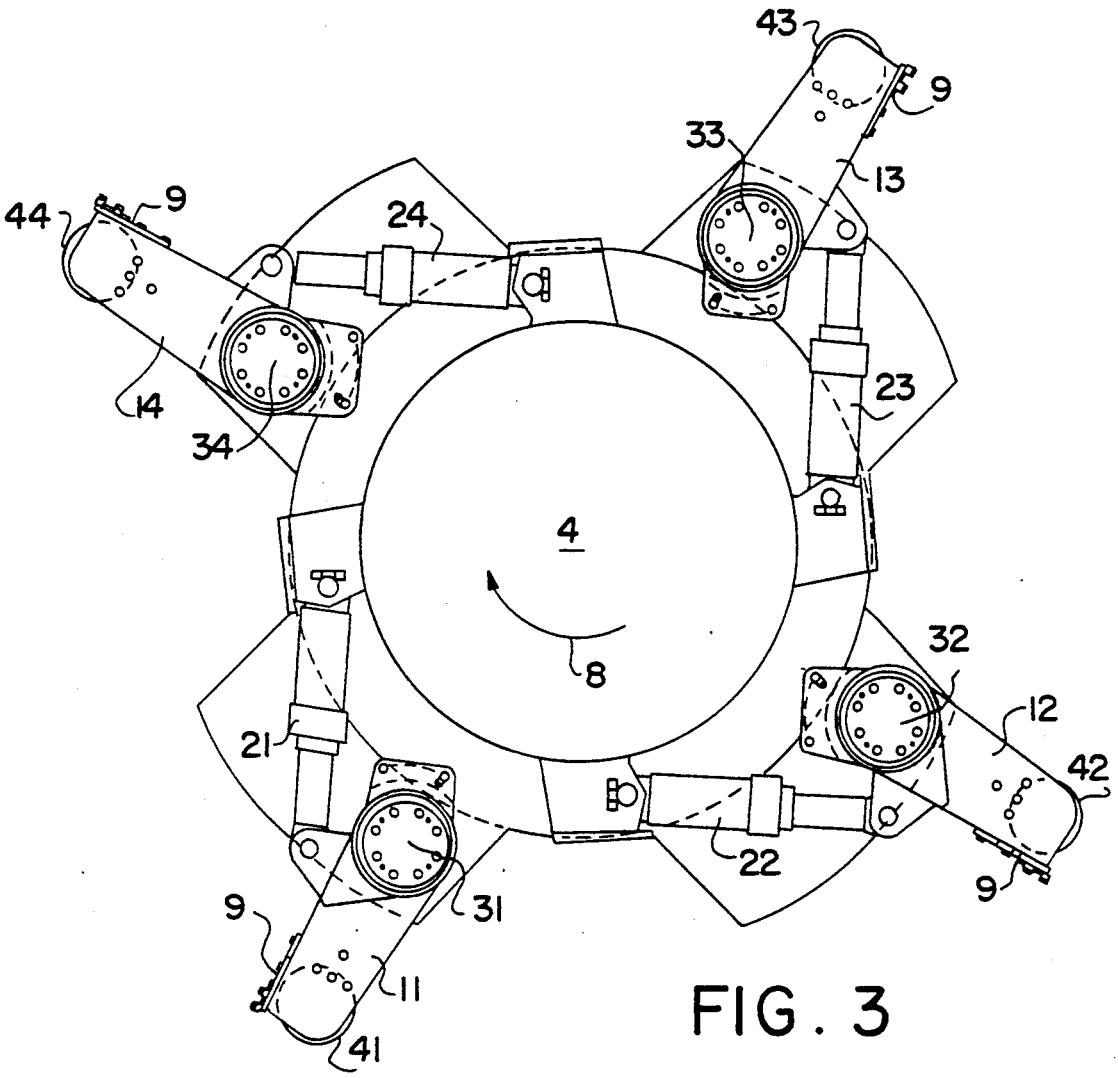
FIG. 3 illustrates a sectional view of a boring head of a tunnel boring machine illustrated by FIG. 1 with certain components removed for clarity purposes.
Figure 2:
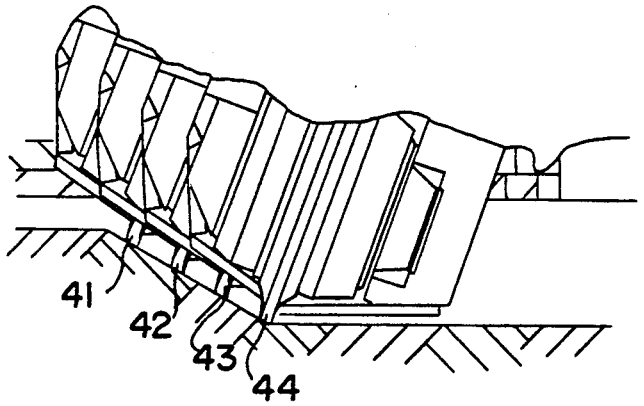
FIG. 2 illustrates a detailed perspective view of a portion of the tunnel boring machine illustrated by FIG. 1.

The tunnel boring machine shown in the drawings comprises a housing 1 which by means of hydraulically maneuverable clamps 2 is fixable relative to a tunnel wall 3. The machine further comprises a boring head 4 which is rotatable relative to the housing 1 about a rotation axis 10 by means of one or more driving motors 5. The boring head is provided with a number of boring tools 6 for the working of a tunnel front 7. The boring head 4 is provided with a number of swingable arms 11, 12, 13, 14 which by means of hydraulic cylinders 21, 22, 23, 24 are swingable about axes 31, 32, 33, 34. The arms are provided with boring tools 41, 42, 43, 44. The direction of rotation of the boring head is marked by the arrow 8. Boring tools 41, 42, 43, 44 are during boring protected by plates 9 which cover the larger part of the boring tools so that only the outer part of the cutter comes in direct contact with the rock. In the position shown in FIG. 3 arms 11, 12, 13, 14 are swung out against not shown stops whereby the arms during operation are kept in swung out position for the working of the tunnel wall outside its normal diameter by the forces from the tunnel wall. In FIG. 2 the different arms are shown as if they were in the same plane to more clearly show that the boring tools on the different arms are positioned at different distances from the axis of rotation of the boring head and at different distances from the tunnel front. Through this it is possible to obtain a larger increase of the tunnel diameter than would be the case if the boring tools were at the same distance from the axis of rotation. When the tunnel is to be driven with normal diameter the hydraulic cylinders are maneuvered so that the arms 11, 12, 13, 14 are drawn in to their inactive positions. The boring head is furthermore provided with not shown locking means which lock the arms in extended positions or in retracted positions so that the hydraulic cylinders need not be used in order to keep the arms in place.

We claim:

1. Tunnel boring machine comprising a housing being fixedly positioned relative to a tunnel wall, with a boring head rotatably mounted relative to said housing, said boring head having an outer surface defining a periphery, said boring head being provided with a first plurality of boring tools on a front surface thereof for boring a tunnel in a direction forwardly of said boring head, and a motor for rotating the boring head, said tunnel boring machine further comprising a second plurality of boring tools and a plurality of arms mounted to the periphery of said boring head, each of said second plurality of boring tools being carried by a different one of said plurality of arms, and means operatively associated with said second plurality of arms for selectively and independently swinging each of said plurality of arms between a retracted inactive position in which said tool carried by said arm is proximate to said periphery of said boring head and an extended operating position in which said tool carried by said arms extends beyond said periphery of said boring head.

2. Tunnel boring machine according to claim 1, wherein said second plurality of boring tools on said plurality of arms in said extended operating positions are situated at different distances from an axis of rotation of the boring head and at different distances from a tunnel front.

3. Tunnel boring machine according to claim 1, further including means for generating forces applied to said plurality of arms from said tunnel wall for maintaining said plurality of arms in said extended operating positions during rotation of said boring head.

4. Tunnel boring machine according to claim 3, wherein said second plurality of said boring tools on said plurality of arms in said extended operating positions are situated at different distances from an axis of rotation of the boring head and at different distances from a tunnel front.

* * * * *